US010477650B2

(12) United States Patent
Wray

(10) Patent No.: US 10,477,650 B2
(45) Date of Patent: Nov. 12, 2019

(54) DIGITAL LIGHTING CONTROL METHOD AND SYSTEM

(71) Applicant: Donald L. Wray, Ocala, FL (US)

(72) Inventor: Donald L. Wray, Ocala, FL (US)

(73) Assignee: USAI, LLC, New Windsor, NY (US)

( * ) Notice: Subject to any disclaimer, the term of this patent is extended or adjusted under 35 U.S.C. 154(b) by 0 days.

(21) Appl. No.: 15/913,512

(22) Filed: Mar. 6, 2018

(65) Prior Publication Data

US 2018/0263095 A1 Sep. 13, 2018

Related U.S. Application Data

(60) Provisional application No. 62/467,405, filed on Mar. 6, 2017.

(51) Int. Cl.
*H05B 37/02* (2006.01)
*H05B 33/08* (2006.01)

(52) U.S. Cl.
CPC ..... *H05B 37/0245* (2013.01); *H05B 33/0845* (2013.01)

(58) Field of Classification Search
CPC ..... H05B 37/0245; H05B 33/0845; H05B 33/0815
See application file for complete search history.

(56) References Cited

U.S. PATENT DOCUMENTS

2008/0180718 A1* 7/2008 Yamashita ..... G06F 11/0709 358/1.15
2010/0181935 A1* 7/2010 Wu ..... H05B 41/3921 315/307
2012/0133298 A1* 5/2012 Campbell ..... H05B 37/0263 315/250
2012/0235579 A1* 9/2012 Chemel ..... F21S 2/005 315/152
2013/0293120 A1* 11/2013 Averitt ..... H05B 41/295 315/158
2015/0108901 A1* 4/2015 Greene ..... H05B 37/0218 315/149
2015/0257240 A1* 9/2015 Matovina ..... H05B 37/0263 315/312
2016/0353560 A1* 12/2016 Bortolotti ..... H04W 4/70
2016/0360594 A1* 12/2016 Chemel ..... H05B 37/0227
2018/0042090 A1* 2/2018 Riley ..... H04L 41/0813

* cited by examiner

*Primary Examiner* — Dedei K Hammond
*Assistant Examiner* — Raymond R Chai
(74) *Attorney, Agent, or Firm* — St. Onge Steward Johnston & Reens LLC

(57) ABSTRACT

A system for controlling LED light fixtures such that in the event of a loss of the lighting control signal the LED light fixtures may be controlled in a proper and predictable manner. The system includes a Digital Power Module (DPM) that receives the lighting control signal and transmits a control signal to a Fixture Control Module (FCM) connected to the LED lights. In the event the lighting control signal is not received by the DPM, it is adapted to send a backup control signal to the FCM to control the LEDs. Additionally, in the event the DPM fails to send a control signal to the FCM, the FCM is adapted to control the LEDs is a predefined manner such that the LEDs are always functional even with a loss of the input control signal.

25 Claims, 5 Drawing Sheets

DIGITAL LIGHTING CONTROL METHOD AND SYSTEM

FIELD OF THE INVENTION

The system relates to a lighting control system for use in controlling LED light fixtures, and more particularly, to a lighting control system that allows for LED light fixtures to be controlled even in the event of a loss of a control signal to the LED light fixtures.

BACKGROUND OF THE INVENTION

Lighting for commercial, residential and industrial applications has substantially evolved over the past ten years. Previously, a common type of lighting used for illumination in residential applications was incandescent, and for commercial and industrial was fluorescent and various high intensity discharge lights. However, while Light Emitting Diodes (LEDs) have been used for many years in display screens, in electronic applications and for specialty lighting, the light output capabilities of LED light fixtures have now allowed them to be used in many differing lighting applications. Additionally, the relatively low power consumption and high controllability of these types of fixtures, has made them desirable for general as well as specialty lighting applications.

LEDs that are used in LED light fixtures for interior lighting are high output devices that emit illuminating light for use in wide variety of lighting applications including residential, commercial and industrial installations. The color of the light emitted by an LED light fixture can vary. For example, it could be white, or virtually any color when primary colored LEDs Red, Green, Blue, White (RGBW) are utilized. However, virtually any color LEDs can be used, including for example, yellow, yellow green, uV or laser diodes. Other LED colors could be a deep red color (closer to IR) but visible for agriculture, aquaculture and medical uses as well. Remote phosphor luminaires could use this technology. Accordingly, the possible applications are quite large and varied.

Likewise, LEDs may be dimmed to control the overall brightness. Alternatively, individual LEDs can be dimmed to achieve a particular look and feel (e.g., a "white" light can have the blue LED dimmed to shift the color slightly toward yellow to give the light a "warmer" feel mimicking an incandescent lamp). Often LED light fixtures are controlled remotely by a digital control signal via a network connection and/or via a local wall-mounted device such as a slide-type dimmer or controller with preprogrammed "scenes" that set color and brightness.

A major drawback with known systems however, is that in the event of a loss of the control signal, for example, loss of a digital control signal, the LED light fixtures could operate in an undesirable or even in an unpredictable manner. It is possible that the LED light fixtures could cease operating altogether. Loss of control of the LED light fixture is not only undesirable because the lighting provided could be inappropriate for the application, but it could also be dangerous if the fixtures are also used for emergency lighting in the event of a loss of power to a building. This problem arises from the fact that LED light fixtures may receive power and control signals separately. For example, building power and lighting control signals may be supplied separately to a Digital Power Module (DPM), which in turn provides separate low-voltage power and control signal outputs to LED light fixtures. However, if the control signal to the DPM and/or to LED light fixtures is interrupted, the LED light fixtures may not function properly even though the light fixtures may still have power.

What is needed then, is a system that will address the issue of a loss of a control signal for controlling an LED light fixture.

SUMMARY OF THE INVENTION

In view of the foregoing, what is needed is a system and method that will account for the loss of a control signal to an LED light fixture, such that it is assured that the LED light fixture will continue to function properly.

It is also desired to provide a system and method for controlling an LED light fixture such that, in the event of the loss of a control signal, the fixture will function in a predictable and desired fashion.

It is further desired to provide a system and method for controlling an LED light fixture such that, in the event of the loss of a control signal, the fixture will still be able to be controlled for various applications.

These and other objects are achieved in one configuration where an LED light control system is provided that includes a DPM that is adapted to be connected to an AC power source (e.g., building system power) and configured to receive various control inputs including, for example, Digital Muliplex (DMX), Digital Addressable Lighting Interface (DALI), 0-10V input, a program input(s), and so on. The DPM provides both low-voltage power and control output signals to the LED light fixtures. It should be noted that the control inputs and outputs are, in one configuration, separate and apart from the AC power source and low-voltage power. Additionally, the control signal could comprise either an analog or a digital control signal.

In the event of a loss of control input, the DPM may be adapted to run a program via a controller for controlling the LED light fixtures connected to the DPM. This program can, for example, be saved on a storage (memory), or information can be saved in firmware on the controller. The program or information could be adapted to control the connected LED light fixtures to a specified light level (brightness) and/or specified color. In one configuration, the DPM is provided with multiple output channels where each output channel is connected to one or more Fixture Control Modules (FCM), which is in turn, may be connected to one or more LED light fixtures. The program or information used by the controller could be selected to individually control each output channel such that different control signals can be sent to the different output channels and/or to different LED light fixtures on each output channel. It is further contemplated that the program or information could control the connected LED light fixtures taking into account the last received control signal input. For example, the last received control signal input could be used by the program as one reference source in making a determination of what the appropriate backup control signal should be until control is restored. It is contemplated that the last received control signal, while being one reference source, may not necessarily correspond to the appropriate backup control signal. However, either of these signals could comprise the backup control signal to control the LED light fixtures.

A determination of a loss of control could occur over a period of time or over a received number of data packets. The time between when the last valid signal was received and a determination of loss of control could be programmable. For example, an instantaneous loss of a valid signal (e.g., a loss of one second or less) could be interpreted by the controller as a loss of control, or a loss of a valid signal for a time exceeding one minute could be interpreted as a loss of control, or another suitable longer or shorter time. Loss of a signal for less than the predetermined time and/or predetermined number of packets can be ignored by the system. Alternatively, if the controller receives a certain number of sequentially corrupted data packets (or a certain number of corrupted data packets within a specified time frame), this could be interpreted as a loss of control.

A determination of a return of control can occur immediately upon resumption of a valid control signal (e.g., within one second or less), or can occur after a predetermined delay (e.g., after 15 seconds or shorter or longer period) or after receipt of a predetermined number of valid data packets. As above, the time (or packets) between when the first valid signal is received and a determination of a return of signal could be programmable. A resumption of a signal for less than the predetermined time (and/or packets) could be ignored by the system. A re-occurrence of a loss of signal during the predetermined time (and/or packets) could also cause the delay period to re-start.

Another possible failure point is if the DPM fails to send or relay valid control signals to the connected LED light fixtures. If the connected LED light fixtures are still being supplied with DC power, the light fixtures themselves could be set to a desired state as a preprogrammed or preselected setting.

Alternatively or additionally, the FCM could operate the LED lights in a manner to provide a visual indication of the loss of digital signal, for example, by pulsing or flashing the LED lights at regular or irregular intervals. On return of a valid control signal to the FCM, the system could then resume control based on a received control signal. The determinations of loss of control to the FCM and resumption of digital control to the FCM can be made in similar manners as described above with respect to the DPM.

A further potential mode of failure of the LED light fixtures is over temperature. In one configuration, a temperature sensor (in the processor or elsewhere) may comprise a thermistor or the like in the FCM to monitor the temperature of the fixture, or one or more components thereof. Likewise, the temperature sensor could comprise a plurality of sensors that monitor various independent components of the light fixture. In the event of an over temperature condition (temperature reaching or exceeding a predetermined maximum temperature threshold for at least a predetermined period), the processor may then set the LED light fixture to a predetermined mode or setting. This predetermined mode or setting could be: to dim the LED lights to a predetermined level, or turn off, or pulse/blink at an interval.

When the temperature returns to normal (temperature drops or below the predetermined maximum temperature threshold for at least a predetermined period), the system could be programmed to resume normal operation. For example, a return to normal temperature can be when the temperature falls to or below a resumption temperature threshold which may comprise the same or a lower temperature than the maximum temperature threshold. Additionally, the predetermined amount of time may be instantaneous.

It will be understood by those of skill in the art that this function can be programmable where the maximum and resumption temperature thresholds, and the predetermined periods of time may be selectable. Still further, it is contemplated that the various temperature sensors could be monitored by the FCM and be connected via a network connection to a computer. In this manner, all the LED light fixtures could be coupled to a control system that provides information on relating to the operation and functioning of each of the LED light fixtures installed as well as provide temperature information for various points about the building. This type of information could be used for maintenance purposes, for preventative maintenance or could even be used by emergency personal for sensing penitential fire safety issues. It is contemplated that the monitoring system could be local (in the building) or could be remote (located in a central monitoring location). All of this information could be gathered and analyzed by the system such that automated alarms or automated alerts indicating a failure of a DPM, or failure of a FCM, for failure of an LED light fixture could be identified and/or anticipated failure could be identified.

For this application the following terms and definitions shall apply:

The term "loss of control" as used herein means a state in which no valid signal (e.g., no discernable information) is received by the receiving device. This could be over a predetermined period of time and/or a predetermined number of data packets.

The term "data" as used herein means any indicia, signals, marks, symbols, domains, symbol sets, representations, and any other physical form or forms representing information, whether permanent or temporary, whether visible, audible, acoustic, electric, magnetic, electromagnetic or otherwise manifested. The term "data" as used to represent predetermined information in one physical form shall be deemed to encompass any and all representations of the same predetermined information in a different physical form or forms.

The term "network" as used herein includes both networks and internetworks of all kinds, including the Internet, and is not limited to any particular network or inter-network.

The terms "first" and "second" are used to distinguish one element, set, data, object or thing from another, and are not used to designate relative position or arrangement in time.

The terms "coupled", "coupled to", "coupled with", "connected", "connected to", and "connected with" as used herein each mean a relationship between or among two or more devices, apparatus, files, programs, applications, media, components, networks, systems, subsystems, and/or means, constituting any one or more of (a) a connection, whether direct or through one or more other devices, apparatus, files, programs, applications, media, components, networks, systems, subsystems, or means, (b) a communications relationship, whether direct or through one or more other devices, apparatus, files, programs, applications, media, components, networks, systems, subsystems, or means, and/or (c) a functional relationship in which the operation of any one or more devices, apparatus, files, programs, applications, media, components, networks, systems, subsystems, or means depends, in whole or in part, on the operation of any one or more others thereof.

In one configuration, a lighting control system for use in controlling LED light fixtures is provided comprising: a Digital Power Module (DPM) having: a power input adapted to be connected to a source of electrical power, a control input adapted to receive a lighting control signal from a control input device, a controller, a storage coupled to the controller and a plurality of outputs. The lighting control system further comprises a plurality of Fixture Control Modules (FCM) each having: an input adapted to be connected to one of the plurality of outputs of the DPM and an LED light fixture connected thereto. The system is provided such that in the event of a loss of the lighting control signal, the DPM transmits a backup control signal on the plurality of outputs such that the LED light fixtures are controlled according to the backup control signal In another configuration, a method for controlling LED light fixtures is provided comprising the steps of: connecting electrical power to a Digital Power Module (DPM), connecting a lighting control signal to an input of the DPM and transmitting an output signal on a plurality of outputs, where each output is connected to a Fixture Control Modules (FCM), where each FCM is connected to an LED light fixture. The method is provide such that in the event of a loss of the lighting control signal, the DPM transmits a backup control signal on the plurality of outputs such that the LED light fixtures are controlled according to the backup control signal.

In still another configuration, a lighting control system for use in controlling LED light fixtures is provided comprising: a Digital Power Module (DPM) having: a power input adapted to be connected to a source of electrical power, a control input adapted to receive a lighting control signal from a control input device, a controller and a plurality of outputs adapted to transmit a control signal. The lighting control system further comprises: a plurality of Fixture Control Modules (FCM) each having: an input adapted to be connected to one of the plurality of outputs of the DPM and receive the control signal, a processor, a storage coupled to the processor and an LED light fixture connected thereto. The system is provided such that in the event the DPM fails to transmit the control signal to the FCM, the FCM is adapted to transmit a default signal to the LED light fixture such that the LED light fixture is controlled according to the default signal.

Other objects of the invention and its particular features and advantages will become more apparent from consideration of the following drawings and accompanying detailed description.

DETAILED DESCRIPTION OF THE INVENTION

Figure 1:
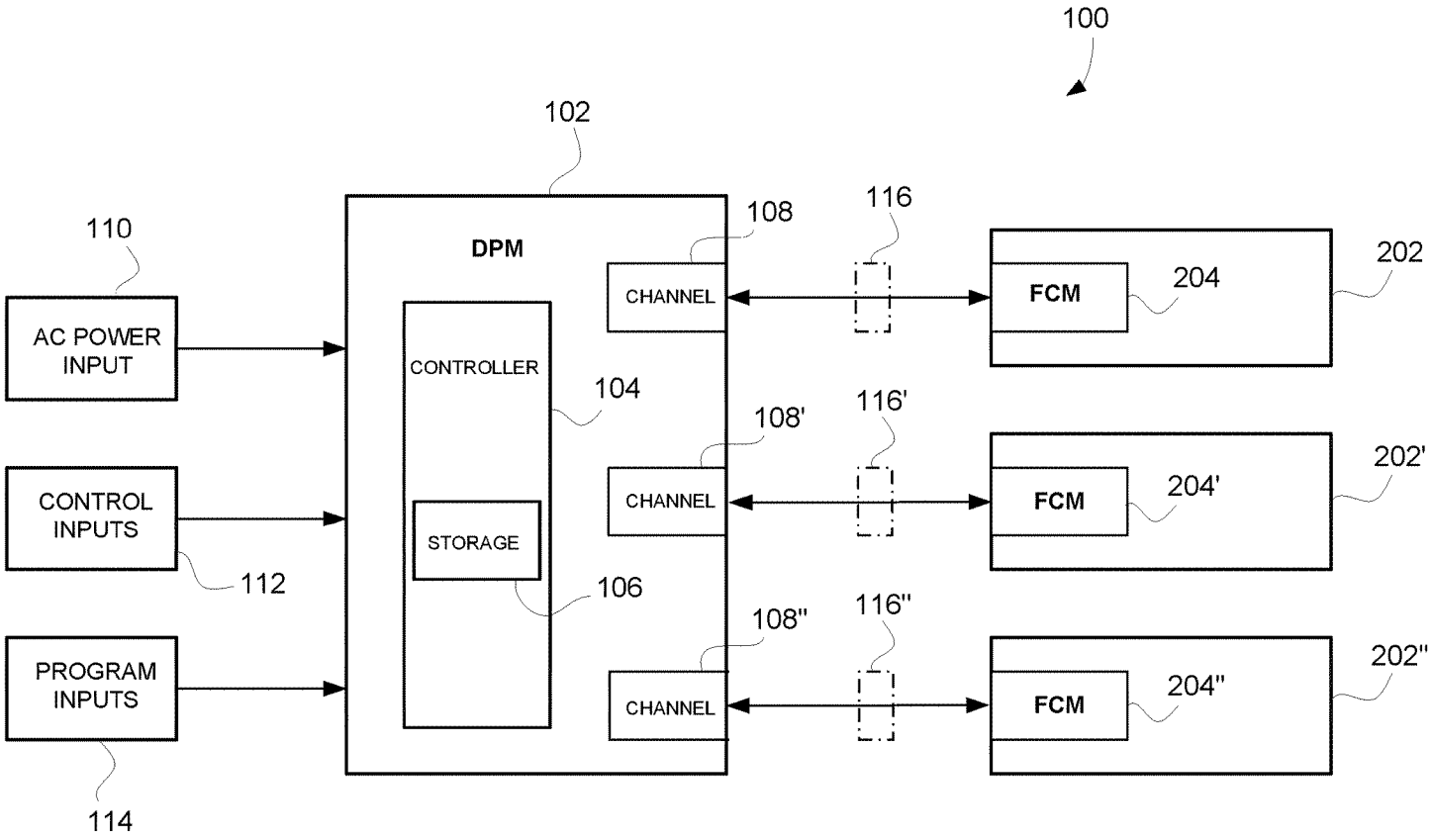
FIG. 1 is a block diagram of one configuration of the lighting control system illustrating a DPM connected to a plurality of LED light fixtures.

Referring now to the drawings, wherein like reference numerals designate corresponding structure throughout the views.

With reference to FIG. 1, a lighting control system 100 for use with LEDs light fixtures 202, 202', 202" are provided for use in various lighting environments. The system generally includes, a Digital Power Module (DPM) 102 that has a Power input 110 (e.g., an A/C or D/C power connection), a lighting control input 112 that may be wired or wireless, and a program input 114. The DPM 102 may further comprise a plurality of channels 108, 108', 108", which are adapted to be coupled to LED light fixtures 202, 202', 202". The DPM 102 is illustrated comprising a controller 104 including a storage 106. The controller 104 may comprise, for example, a computer, a digital signal processor, a field-programmable gate array, an application-specific integrated circuit, a microprocessor, a micro-controller, or any other form of programmable hardware.

The LED light fixtures 202, 202', 202" are illustrated being remotely located from and connected to the DPM 102 via channel 108, 108', 108" by wiring 116, 116', 116" respectively. Each LED light fixture 202, 202', 202" includes a Fixture Control Module (FCM) 204, 204', 204". Wiring 116, 116', 116" may comprise low-voltage wiring, through which power and (optionally) control signals are separately transmitted between DPM 102 and FCM 204, 204', 204". Additional LED lighting fixtures (not shown) may be connected to each channel, such as in a daisy-chain configuration. For this purpose, the FCM can include a DC power output and a control signal output (not shown) to relay power and control signals to the additional fixtures.

Figure 2:
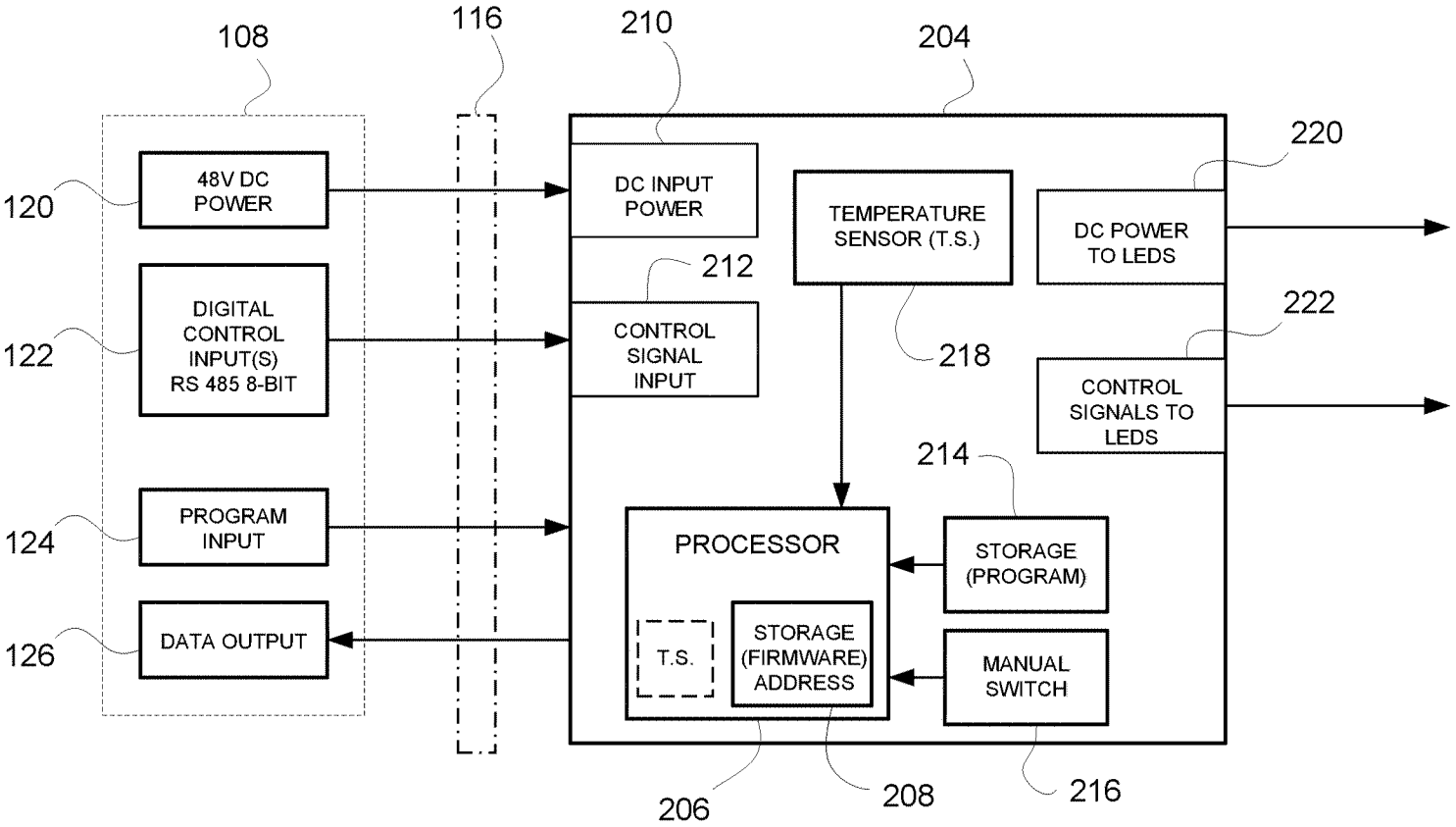
FIG. 2 is a block diagram according to FIG. 1 illustrating the FCM in greater detail.

Turning now to FIG. 2 the FCM 204 is illustrated in greater detail. Additionally, an expanded view of the various signals being transmitted via wiring 116 is illustrated. Channel 120 of DPM 102 is used to output DC power 120 (48V) from DPM 102 to FCM 204 and is received by DC input power connection 210. Digital control inputs 122 are also transmitted from DPM 102 to FCM 204 and is received by control signal input connection 212. Additionally, a program input 124 is transmitted from DPM 102 to FCM 204.

FCM 204 is provided with a processor 206 that may include a storage 208, which may or may comprise firmware including an address. A storage 214 is also illustrated for storing a program and data thereon. Additionally, or alternatively, a manual switch 216 is illustrated on FCM 204. It is contemplated that any or all of these various components may be used or omitted in the FCM 204. In one configuration, the processor 206 includes firmware that has an address located thereon such that the FCM 204 may be located via a network connection for transmission of data to control the FCM and associated LEDs. In another configuration, the storage 214 includes a program such that the associated LEDs could be controlled based upon instructions received by the FCM 204 and by the program saved on the storage 214. In still another configuration, the FCM 204 could have an address set by configuring the manual switch 216, which could comprise a DIP switch including a plurality of switch positions.

Also shown in FIG. 2 is temperature sensor 218, which may comprise, for example, a thermistor. A thermistor is a device that will change resistance based on the surrounding ambient temperature thereby allowing the FCM 204 to measure the temperature in the vicinity of the FCM 204. The temperature signal that is generated by the temperature sensor 218 may be received by the processor 206 and processed, and optionally such that it may be transmitted via data output 126 to DPM 102. The temperature sensor 218 is illustrated as external to processor 206, however, it is contemplated that temperature sensor 218 may be provided integral with processor 206 (this alternative configuration is illustrated with the T.S. in dashed line inside processor 206).

FCM 204 is provided with a DC power output 220 and a control output 222, which are adapted to be coupled to LED lights positioned within the LED light fixture 202. Optionally, the FCM can drive the LED lights with the DC power output 220, such as by analog modulation or a pulse-width modulation (PWM) technique.

Figure 3:
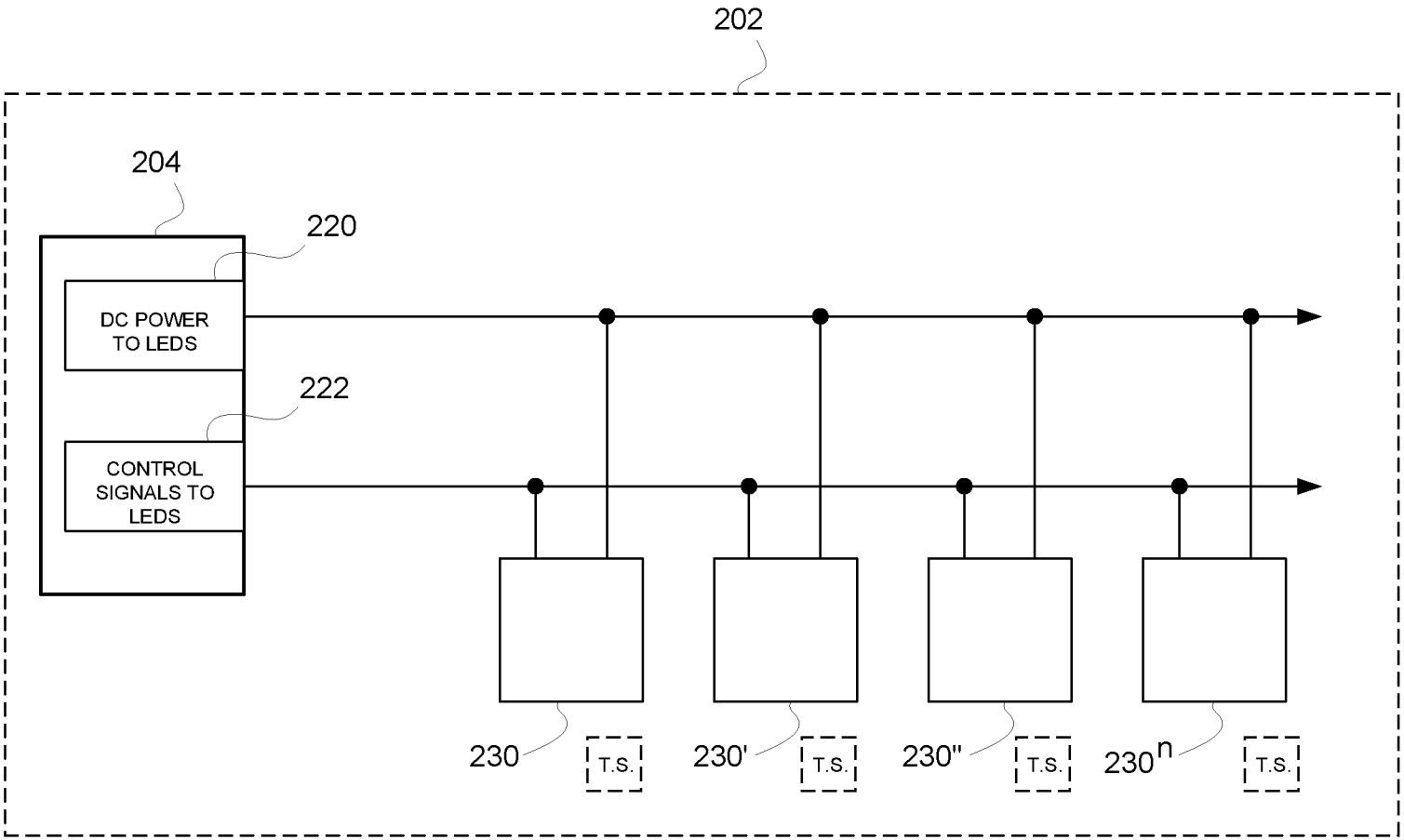
FIG. 3 is a block diagram according to FIG. 1 illustrating the LED light fixture in greater detail.

FIG. 3 illustrates the LED lights 230, 230', 230", 230''' within LED light fixture 202. LED lights 230, 230', 230", 230″ may include, for example, from between one to twelve LEDs and comprise RGBW allowing for virtually any color to be generated. The FCM is operable to drive the LEDs to produce a plurality of light colors and/or to dim the LED lights 230, 230', 230", 230″ to produce a plurality of light intensities, in response to the control signal received from the DPM. The FCM can include a separate power output and/or control signal for each LED light.

In one configuration, data received by FCM 204 may be in the form of an RS-485 data stream that when decoded, provide brightness level data in an 8-bit format. One to four bytes of data (one per color) could be outputted from the controller port as Pulse Width Modulated (PWM) signals with the pulse width proportional to the brightness level of the received data. Analog modulation of the LED's may also be used with the FCM 204.

In one example, during operation one to four voltage-to-constant current buck-down converters or analog FETs with D/A conversion will drive the one through four strings of LED's each comprising 1-12 LED(s) with the dimming function allowing for ON and OFF control via the PWM signal or analog controlling current through the LED rows to dim the LED rows internal to the fixture. The FCM PCB may have one or two RJ type Cat-5 compatible (or other suitable) connectors for connection to the DPM and additional FCMs/LED light fixtures. The 48 VDC used to power the controller and the LED(s) can also be supplied over the low voltage cable.

Figure 4:
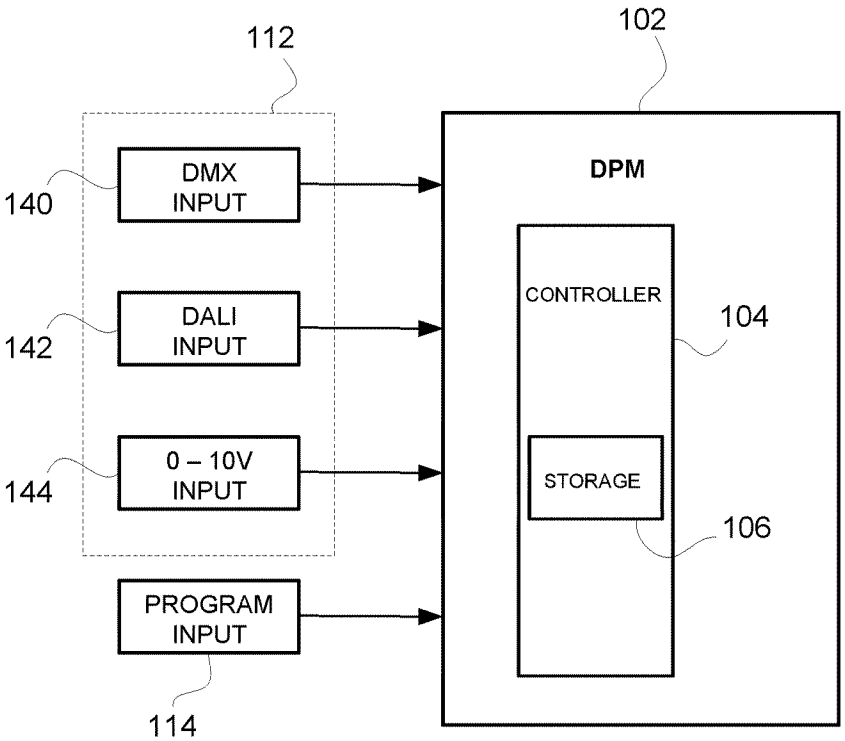
FIG. 4 is a block diagram according to FIG. 1 illustrating a plurality of DPMs connected to a computer via a network connection.

FIG. 4 illustrates the DPM 102 having a variety of lighting control inputs 112 (interfaces). For example, lighting control input 112 could comprise a DMX input 140, a DALI input 142 or a 0-10V input 144. These lighting control inputs 112 are separate and apart from program input 114.

0-10V input 144 may comprise an analog 0-10V "dimmer" type of control, which in one configuration could comprise two dimmers (e.g., one for color and one for brightness). In addition to these controls, the system could use a DMX digital control interface. When some or all of these controls are provided, the DPM allows for some new and unique ways to address interface failures and still allow some user control to the LED light fixtures. For example, assuming RGBW LED light fixtures are connected to the DPM and the DPM is set to DMX interface; if the DMX controller connected to the DPM fails, firmware (or software) in the DPM could be programmed to also be looking at the 0-10V "dimmer control" so as to allow a user to turn on and off and dim a white light (or pre-programmed color) when the DMX control interface is not functioning properly (e.g., the backup control signal corresponds to the dimmer control). While lighting control input 112 is illustrated as a "wired" connection, it is contemplated that either a wired or wireless connection to DPM 102 may effectively be utilized. Likewise, it is contemplated that program input 114 may comprise either a wired or wireless connection. In both cases, a Blue Tooth connection could be used to send signals to the DPM. It could be convenient to wirelessly connect to the DPM via program input 114 via a handheld tablet device for programming the system. Alternatively, a tablet could be located in room (conference room) and could be used to control the lighting including the setting of various "scenes" having preselected color and brightness levels.

Alternatively, if a 0-10V dimmer is not connected to the system, then the system could interpret the 0-10V control input as a 0-10V dimmer set to full (100%) brightness, which in turn would cause the DPM to set the light fixture to fully ON. Alternatively, the DPM could be pre-programmed to drive the LED light fixture at a different brightness level (e.g., 80% or 60%, etc.). This assures that the system 100 will continue to provide illuminating light even if the DMX wireless control interface fails to function properly by means of a backup control signal. It is contemplated that the program input 114 could be used to program controller 104 for default settings in the event of a loss of the lighting control signal. Additionally, it is contemplated that program input could be used to program the FCM 204 (e.g., firmware on processor 206 or saving of a program on storage 214, etc.).

Figure 5:
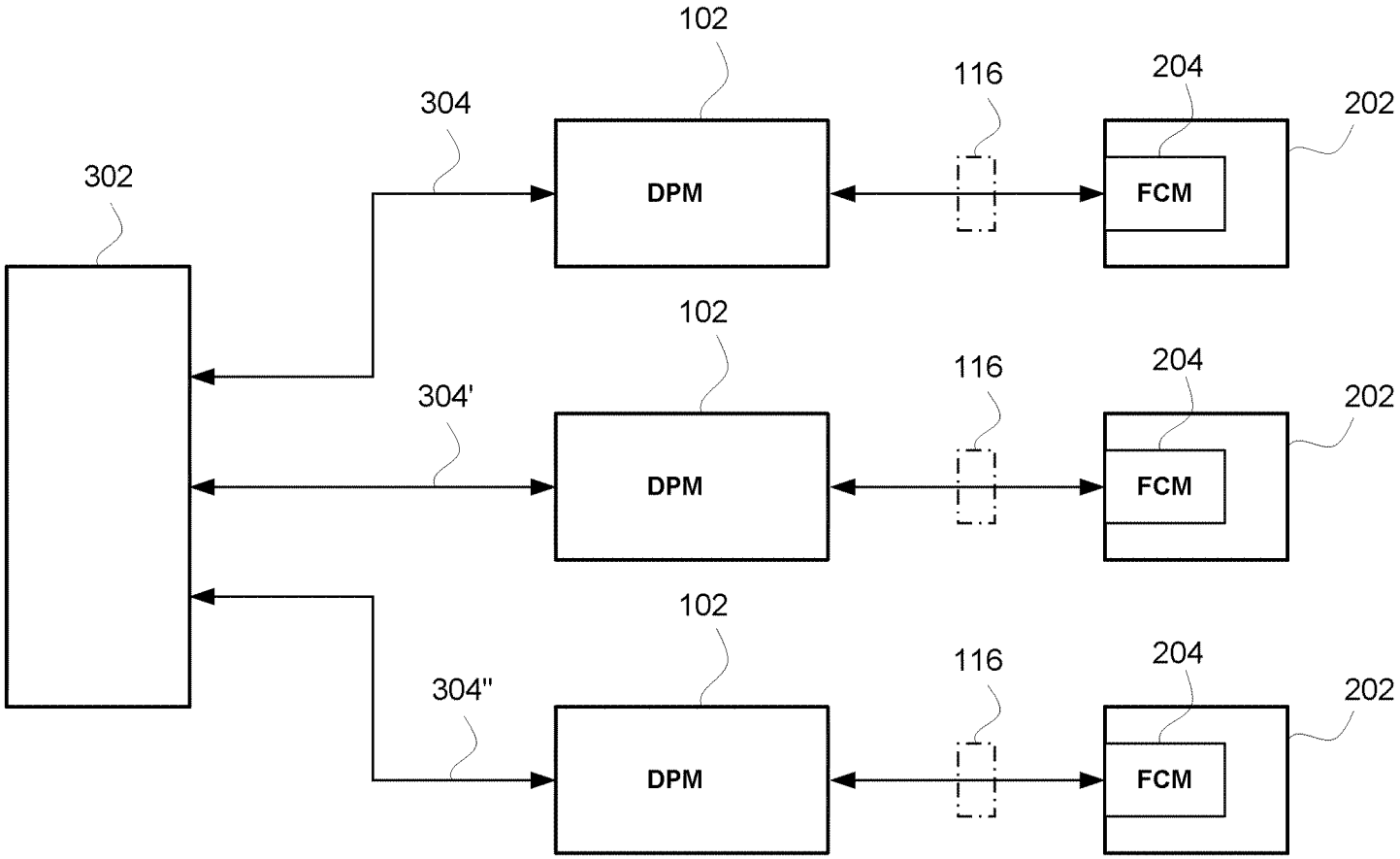
FIG. 5 is a block diagram according to FIG. 1 illustrating control inputs in greater detail to the DPM.

FIG. 5 illustrates a number of different DPMs 102, each with their respective LED light fixtures 202 and FCMs 204 in accordance with FIGS. 1-4. However, also depicted in FIG. 5 is computer 302, which is variously connected to the DPMs 102 via network connection 304. The network connection may comprise for example, the Internet. Computer 302 may be used to remotely monitor the status and control of the various DPMs 102 and LED light fixtures 202 connected thereto. It is contemplated that in one configuration, two way communication can be provided between computer 302 and LED light fixtures 202.

The system 100 can be adjusted to monitor for a loss of the lighting control signal to the DPM 102. In this regard, the following process may be implemented: 1. Set light color to predetermined color (e.g., white or other color); and 2) Set the light intensity based on a 0-10V control signal level, if present, or if not, to a predetermined level (e.g., 100%, 80%, 45% and so on).

In the event of a return of the lighting control signal to the DPM 102 after a determination of a loss of the lighting control signal, the system may resume "normal" operation and allows for the resumption of the remote digital control setting.

As was previously stated, when discussing what is a loss of control (e.g., a digital control signal), this refers to a state in which no valid signal is received by the receiving device, which in this case, would be DPM 102 monitoring for a lighting control signal. The loss of the lighting control signal could be determined over a predetermined period of time and/or a predetermined number of data packets. The time between when the last "valid" (understandable) signal was received and a determination of loss of the lighting control signal could can be programmable and set in controller 104 via program input 114. In one example, an instantaneous loss of a valid signal (e.g., a loss of one second or less) could be interpreted as a loss of a lighting control signal, or not receiving a valid signal for a time exceeding one minute (or any other time frame) could be interpreted as a loss of a lighting control signal. Lack of a valid signal for less than the predetermined time and/or predetermined number of packets could simply be ignored by system 100.

A determination of a return of the lighting control signal could occur immediately upon resumption of a valid lighting control signal (e.g., within one second or less), or could occur after a predetermined delay (e.g., after 15 seconds or some other time frame), or even after receipt of a number of valid data packets. A resumption of a "valid" signal for less than the predetermined time could be ignored by system 100. Likewise, a re-occurrence of a loss of the lighting control signal during the predetermined time could cause the delay period to re-initiate.

Another possible failure point is the DPM 102. It is understood that the DPM could receive a valid lighting control signal, but still fail to send or relay a valid control signal(s) to the connected LED light fixtures 202, 202', 202".

If the connected LED light fixtures are still being supplied with DC power, the LEDs could be set to a desired state as a preprogrammed setting.

In one example, the FCM 204 monitors for a lighting control signal transmitted through channel 108 along wiring 116. When a loss of a lighting control signal to the FCM 204 occurs, the FCM 204 could operate to set the LEDs with a default mode to the last "valid" state corresponding to the last "valid" lighting control signal received from DPM 102. Alternatively, the default mode from the FCM 204 could set the LEDs to a predetermined color and/or brightness according to a program or data saved in storage 208, 214. Alternatively or additionally, the FCM could operate the LED lights in a manner to provide a visual indication to those in the area, of the loss of the lighting control signal. This could be accomplished, for example, by pulsing or flashing the LEDs at regular or irregular intervals. On a return of a valid lighting control signal to the DPM 102, the system 100 will cease using the default mode and resume control based on the lighting control signal received. The determinations of loss of the lighting control signal to the FCM 204 and resumption of the lighting control signal to the FCM 204 could be made in similar manners as described above with respect to the DPM 102.

Still another potential mode of failure of the LED light fixtures 202, 202', 202", is light fixture over temperature. In one configuration, the temperature sensor 218 generates a temperature signal indicative of a temperature in the area of the sensor 218. Likewise, the temperature sensor 218 could comprise a plurality of temperature sensors (e.g., illustrated in FIG. 3 with dashed line) adapted to monitor various independent components of the LED light fixture 202. In the event of an over temperature (temperature reaching or exceeding a predetermined maximum temperature threshold for longer than a predetermined period of time), the processor 206 may then set the LED light fixture 202 to a predetermined mode or setting. This predetermined mode or setting could be: to dim the LEDs to a predetermined level, or turn off, or pulse/blink at an interval.

When the temperature returns to normal, the system 100 could then resume normal operation. For example, a return to normal temperature can be when the temperature falls to or below a resumption temperature threshold (saved in storage 208, 214) for a predetermined amount of time, where the resumption temperature threshold may be the same as or lower than the maximum temperature threshold. Likewise, the predetermined amount of time may be instantaneous or some other setting.

It will be understood by those of skill in the art that this function can be programmable where the maximum and resumption temperature thresholds, and the predetermined periods of time may be selectable.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A lighting control system for use in controlling LED light fixtures comprising:

a Digital Power Module (DPM) having:

a power input adapted to be connected to a source of electrical power;

a control input adapted to receive a lighting control input signal from a control input device;

a controller;

a non-transitory computer-usable storage coupled to said controller, said storage having preprogrammed backup control signal data stored thereon, and the preprogrammed backup signal control data corresponding to a selected color or a selected dimming level, where the selected color can be selected from a plurality of predetermined colors and the selected dimming level can be selected from a plurality of predetermined dimming levels;

an output;

a Fixture Control Module (FCM) having:

an input adapted to be connected to the output of the DPM; and an LED light fixture connected thereto;

in the presence of the lighting control input signal, said DPM being operable to transmit a control output signal on said output, based on the lighting control input signal, such that the LED light fixture is controlled according to the lighting control input signal; and in the event of a loss of the lighting control input signal, said DPM being operable to transmit a backup control signal, which is based on the preprogrammed backup control signal data, on said output such that said LED light fixture is controlled according to said backup control signal.

2. The lighting control system according to claim 1 wherein said lighting control input signal is selected from the group consisting of: Digital Multiplex (DMX), Digital Addressable Lighting Interface (DALI), a 0-10V input and combinations thereof.

3. The lighting control system according to claim 1 wherein said controller is selected from the group consisting of: a computer, a digital signal processor, a field-programmable gate array, an application-specific integrated circuit, a micro-processor, a micro-controller, or combinations thereof.

4. The lighting control system according to claim 1 wherein said DPM has a plurality of outputs, further comprising a plurality of FCMs connected to said plurality of outputs, and said backup control signal comprises a plurality of backup control signals sent on said plurality of outputs respectively.

5. The lighting control system according to claim 4 wherein:

said preprogrammed backup control signal data comprises a program adapted to control said LED light fixture to a specified light level or color temperature; and said program generates said plurality of backup control signals such that each of said plurality of outputs is controlled independently from each other.

6. The lighting control system according to claim 5 wherein each of said plurality of outputs is controlled such that the respective LED light fixture connected thereto is controlled differently from the LED light fixtures connected to the other outputs.

7. The lighting control system according to claim 1 wherein said selected backup control signal data comprises a program adapted to control said LED light fixture to a specified light level or a specified color temperature.

8. The lighting control system according to claim 1 wherein a determination of the loss of the lighting control signal is based on an elapse of a time period or a lack of receipt of data packets.

9. The lighting control system according to claim 8 wherein said time period is programmable.

10. The lighting control system according to claim 1 wherein said backup control signal is adapted to operate the LED light fixture in a manner providing a visual indication of the loss of the lighting control signal.

11. The lighting control system according to claim 10 wherein said backup control signal causes the LED light fixtures to pulse or flash.

12. The lighting control system according to claim 1 wherein said FCM further comprises a processor and a FCM storage, and in the event said DPM fails to transmit the control output signal to the FCM, said FCM is adapted to operate said LED light fixture in a default mode based on predefined backup control signal data stored on the FCM storage.

13. A lighting control system for use in controlling LED light fixtures comprising:

a Digital Power Module (DPM) having:

a power input adapted to be connected to a source of electrical power;

a first input adapted to receive a digital input signal;

a second input adapted to receive a 0-10V analog input signal;

a controller;

a storage coupled to said controller;

a plurality of outputs;

a first Fixture Control Module having:

an input adapted to be connected to one of the plurality of outputs of the DPM; and a first LED light fixture connected thereto;

a second Fixture Control Module having:

an input adapted to be connected to one of the plurality of outputs of the DPM; and a second LED light fixture connected thereto;

said DPM is operable to monitor a status of the digital input signal and to detect a presence and a loss of the digital input signal;

wherein in the presence of the digital input signal, said DPM is operable to transmit a control output signal that is based on the digital input signal, such that the first and second LED light fixtures are controlled according to the digital input signal; and wherein in the event of a loss of the digital input signal, said DPM is operable to detect the loss of the digital input signal and transmit a backup control signal that is based on the 0-10V analog input signal, such that said first and second LED light fixtures are controlled according to the 0-10V analog input signal.

14. A method for controlling LED light fixtures comprising the steps of:

selecting backup control signal settings for controlling the LED light fixtures to function in one of a plurality of preprogramed states in the event of a loss of an input lighting control signal;

the backup signal control settings corresponding to a selected color or a selected dimming level, where the selected color can be selected from a plurality of predetermined colors and the selected dimming level can be selected from a plurality of predetermined dimming levels;

storing backup control signal data based on the selected backup control signal settings on a storage in a Digital Power Module (DPM);

transmitting electrical power to the DPM;

transmitting an input lighting control signal to an input of the DPM;

transmitting an output signal on an output, where said output is connected to a Fixture Control Module (FCM) that is connected to an LED light fixture;

controlling the LED light fixture based on the input lighting control signal;

wherein in the event of a loss of the input lighting control signal, the DPM transmits a backup control signal, which is based on the preprogrammed backup control signal data, on the output such that the LED light fixture is controlled according to the backup control signal data.

15. The method according to claim 14 further comprising the step of:

controlling the LED light fixtures to a specified light level or a specified color temperature with the backup control signal.

16. The method according to claim 14 wherein a determination of the loss of the lighting control input signal is based on the elapse of a time period or a lack of receipt of data packets.

17. The method according to claim 14 further comprising the step of:

transmitting a signal to a computer via a network related to a measured temperature.

18. The method according to claim 14 further comprising the step of:

operating said LED light fixtures in a predetermined mode in the event of an overtemperature condition.

19. A lighting control system for use in controlling LED light fixtures comprising:

a Digital Power Module (DPM) having:

a power input adapted to be connected to a source of electrical power;

a control input adapted to receive an input lighting control signal from a control input device;

a controller;

an output adapted to transmit a control signal;

a Fixture Control Module (FCM) having:

an input adapted to be connected to said output and receive the control signal;

a processor;

a non-transitory computer-usable storage coupled to said processor, said storage having preprogrammed backup control signal data stored thereon, and the preprogrammed backup signal control data corresponding to a selected color or a selected dimming level, where the selected color can be selected from a plurality of predetermined colors and the selected dimming level can be selected from a plurality of predetermined dimming levels; and an LED light fixture connected thereto;

in the presence of the input lighting control signal, said DPM being operable to transmit the control signal based on the input lighting control signal, such that the LED light fixture is controlled according to the input lighting control signal; and in the event said DPM fails to transmit the control signal to the FCM, said FCM is adapted to operate said LED light fixture in a default mode based on the preprogrammed backup control signal data stored on the storage.

20. The lighting control system according to claim 19 wherein said lighting control input signal is selected from the group consisting of: Digital Multiplex (DMX), Digital Addressable Lighting Interface (DALI), a 0-10V input and combinations thereof.

21. The lighting control system according to claim 19 wherein said predefined backup control signal data comprises a program adapted to control said LED light fixtures to a specified light level or a specified color temperature.

22. The lighting control system according to claim 19 wherein in said default mode said FCM is adapted to operate the LED light fixture in a manner providing a visual indication of the loss of the lighting control signal.

23. The lighting control system according to claim 19 further comprising a thermistor located in said FCM and adapted to measure a temperature near said LED light fixture.

24. The lighting control system according to claim 23 wherein said LED light fixture is operated in a predetermined mode in the event of an over-temperature condition.

25. The lighting control system according to claim 19 wherein said storage comprises an address.

* * * * *